US008294339B2

(12) United States Patent
Lin et al.

(10) Patent No.: US 8,294,339 B2
(45) Date of Patent: Oct. 23, 2012

(54) LED LAMP AND A HEAT SINK THEREOF HAVING A WOUND HEAT PIPE

(75) Inventors: Kuo-Len Lin, Wugu Township, Taipei County (TW); Chen-Hsiang Lin, Wugu Township, Taipei County (TW); Chih-Hung Cheng, Wugu Township, Taipei County (TW)

(73) Assignees: CPumate Inc., New Taipei (TW); Golden Sun News Techniques Co., Ltd., New Taipei (TW)

( * ) Notice: Subject to any disclaimer, the term of this patent is extended or adjusted under 35 U.S.C. 154(b) by 191 days.

(21) Appl. No.: 12/820,453

(22) Filed: Jun. 22, 2010

(65) Prior Publication Data

US 2011/0309734 A1 Dec. 22, 2011

(51) Int. Cl.
*H01J 7/24* (2006.01)

(52) U.S. Cl. ..... 313/46; 313/45; 362/218; 362/373; 362/547

(58) Field of Classification Search ..... 313/17, 313/20, 33, 46, 45; 362/480, 546, 547, 218, 362/294, 373, 555, 235, 249.01, 249.02; 439/487; 257/81
See application file for complete search history.

(56) References Cited

U.S. PATENT DOCUMENTS 5,808,592 A * 9/1998 Mizutani et al. ..... 345/83
2010/0097783 A1* 4/2010 Gomi ..... 362/97.1
2010/0103678 A1* 4/2010 Van De Ven et al. ..... 362/294
* cited by examiner

*Primary Examiner* — Joseph L Williams
*Assistant Examiner* — Fatima Farokhrooz
(74) *Attorney, Agent, or Firm* — Chun-Ming Shih; HDLS IPR Services

(57) ABSTRACT

The present invention relates to a LED lamp and a heat sink thereof having a wound heat pipe. The LED lamp includes the heat sink, a LED module and a lamp base electrically connected to the LED module. The heat sink includes a heat-conducting base, a heat-dissipating fin set and a wound heat pipe. The heat-dissipating fin set includes a plurality of heat-dissipating fins arranged at the outer periphery of the heat-conducting base. The heat-dissipating fins form an accommodating space. The wound heat pipe includes an evaporating section brought into thermal contact with the heat-conducting base and a condensing section brought into thermal contact with the heat-dissipating fins. The LED module abuts against the heat-conducting base and the evaporating section. By this structure, the heat-conducting path is shortened, the heat-conducting speed is accelerated, and the heat is rapidly and uniformly distributed to the heat-dissipating fins to improve the heat-dissipating efficiency.

18 Claims, 6 Drawing Sheets

LED LAMP AND A HEAT SINK THEREOF HAVING A WOUND HEAT PIPE

BACKGROUND OF THE INVENTION

1. Field of the Invention

The present invention relates to an illuminating device, in particular to a LED lamp and a heat sink having a wound heat pipe.

2. Description of Prior Art

Illuminating devices are very important tools in the civilization of human beings, by means of which people can recognize their locations even in a dark environment. Tungsten lamps are one kind of illuminating devices, in which a tungsten filament is used as a light-emitting source. Thus, the tungsten lamp has a simple structure. When an electric current passes through the tungsten filament, it can be heated to emit light, so that the tungsten lamp can be used for illumination. However, the tungsten filament is prone to be blown and thus the lifetime of the tungsten lamp is short.

With the advancement of science and technology, LED lamps are developed. Light emitting diode (LED) is a solid light source capable of converting electricity into light energy. The LED has advantages of small volume, low driving voltage, fast response and long lifetime, so that LED lamps have been widely used to replace the traditional tungsten lamps.

The conventional LED lamp includes a lamp base, a lamp shroud mounted in the lamp base, and a LED module received in the lamp shroud to abut against the inner bottom wall of the lamp shroud. The LED module is electrically connected to the lamp base. The lamp shroud is made of metallic materials. The heat generated by the LED module is conducted to the lamp shroud for heat dissipation. However, such a heat-dissipating effect is insufficient.

In order to increase the illuminating range and brightness of the LED lamp, the LED module usually has a plurality of LEDs. With the increase of the number of LEDs and the development of high-power LEDs, the amount of heat generated by the LED module is raised to a large extent. If the heat is not dissipated immediately, the heat will be accumulated in the LED module to deteriorate the lifetime of the LED lamp and thus increase the maintenance cost.

Thus, in order to dissipate the heat more efficiently, the outer surface of the metallic lamp shroud is usually provided with a plurality of heat-dissipating fins to improve the heat-dissipating effect of the LED lamp. However, the heat generated by the LEDs is conducted to the lower portion of the lamp shroud, the lower portion of the heat-dissipating fins, the upper portion of the lamp shroud, and finally to the upper portion of the heat-dissipating fins. Thus, the heat-conducting path is long and the heat-conducting speed is low. Furthermore, the heat is not uniformly conducted, so that the heat may be accumulated easily in the lower portion of the lamp shroud. In other words, due to the above-mentioned structure, the heat-dissipating effect of the heat-dissipating fins is not utilized sufficiently.

In view of the above, the present Inventor proposes a novel and reasonable structure based on his researches and expert knowledge in order to solve the problems in prior art.

SUMMARY OF THE INVENTION

The present invention is to provide a heat sink having a wound heat pipe, which is capable of reducing the heat-conducting path, accelerating the heat-conducting process, and conducting the heat to the respective heat-dissipating fins rapidly and uniformly. In this way, the heat-dissipating efficiency is improved greatly.

The present invention provides a heat sink having a wound heat pipe, including:

a heat-conducting base;

a heat-dissipating fin set comprising a plurality of heat-dissipating fins arranged radially, the heat-dissipating fins enclosing to form a central hole for allowing the heat-conducting base to be inserted therein and an accommodating space located aside the central hole, the heat-dissipating fins being provided therein with an annular groove in communication with the accommodating space; and at least one wound heat pipe comprising an evaporating section brought into thermal contact with the heat-conducting base, and a condensing section inserted into the annular groove and brought into thermal contact with the respective heat-dissipating fins.

The present invention is to further provide a LED lamp, which is capable of reducing the heat-conducting path, accelerating the heat-conducting process, and conducting the heat to the respective heat-dissipating fins rapidly and uniformly. In this way, the heat-dissipating efficiency is improved greatly.

The present invention provides a LED lamp, including:

a heat sink having a wound heat pipe, comprising:

a heat-conducting base;

a heat-dissipating fin set comprising a plurality of heat-dissipating fins arranged radially and connected to the heat-conducting base respectively, the heat-dissipating fins enclosing to form an accommodating space; and at least one wound heat pipe comprising an evaporating section brought into thermal contact with the heat-conducting base, and a condensing section wound to be brought into thermal contact with the respective heat-dissipating fins;

a LED module disposed in the accommodating space to abut against one side of the heat-conducting base and the evaporating section; and a lamp base provided on the other side of the heat-conducting base and electrically connected to the LED module.

In comparison with prior art, the present invention has the following advantageous features.

The heat-dissipating fins are arranged radially around the LED module, so that the heat-dissipating fins act as a lamp shroud with a good heat-dissipating effect.

Since the heat pipe has a strong and rapid heat-conducting effect, the heat generated by the LED module can be rapidly conducted by the wound heat pipe to the heat-conducting base and the whole region of the respective heat-dissipating fins. Thus, the heat will not be accumulated in a partial region of the heat-dissipating fins, and the heat-conducting path can be shortened to accelerate the heat-conducting speed. Furthermore, the heat can be distributed uniformly on the respective heat-dissipating fins to utilize the whole area of the heat-dissipating fins so as to achieve a greater heat-dissipating effect.

Besides the heat-dissipating fins achieves a greater heat-dissipating effect, the working fluid in the wound heat pipe can be rapidly condensed at the condensing section and flow back to the evaporating section, so that the efficiency of the wound heat pipe is enhanced greatly.

According to the heat sink having a wound heat pipe, the heat generated by the LED module can be dissipated rapidly, so that the LED module can be kept in a normal range of temperature, thereby extending the lifetime of the LED module and reducing the maintenance cost of the LED lamp can be reduced. Therefore, the LED lamp becomes more economical and practicable.

DETAILED DESCRIPTION OF THE INVENTION

The detailed description and technical contents of the present invention will become apparent with the following detailed description accompanied with related drawings. It is noteworthy to point out that the drawings is provided for the illustration purpose only, but not intended for limiting the scope of the present invention.

Figure 1:
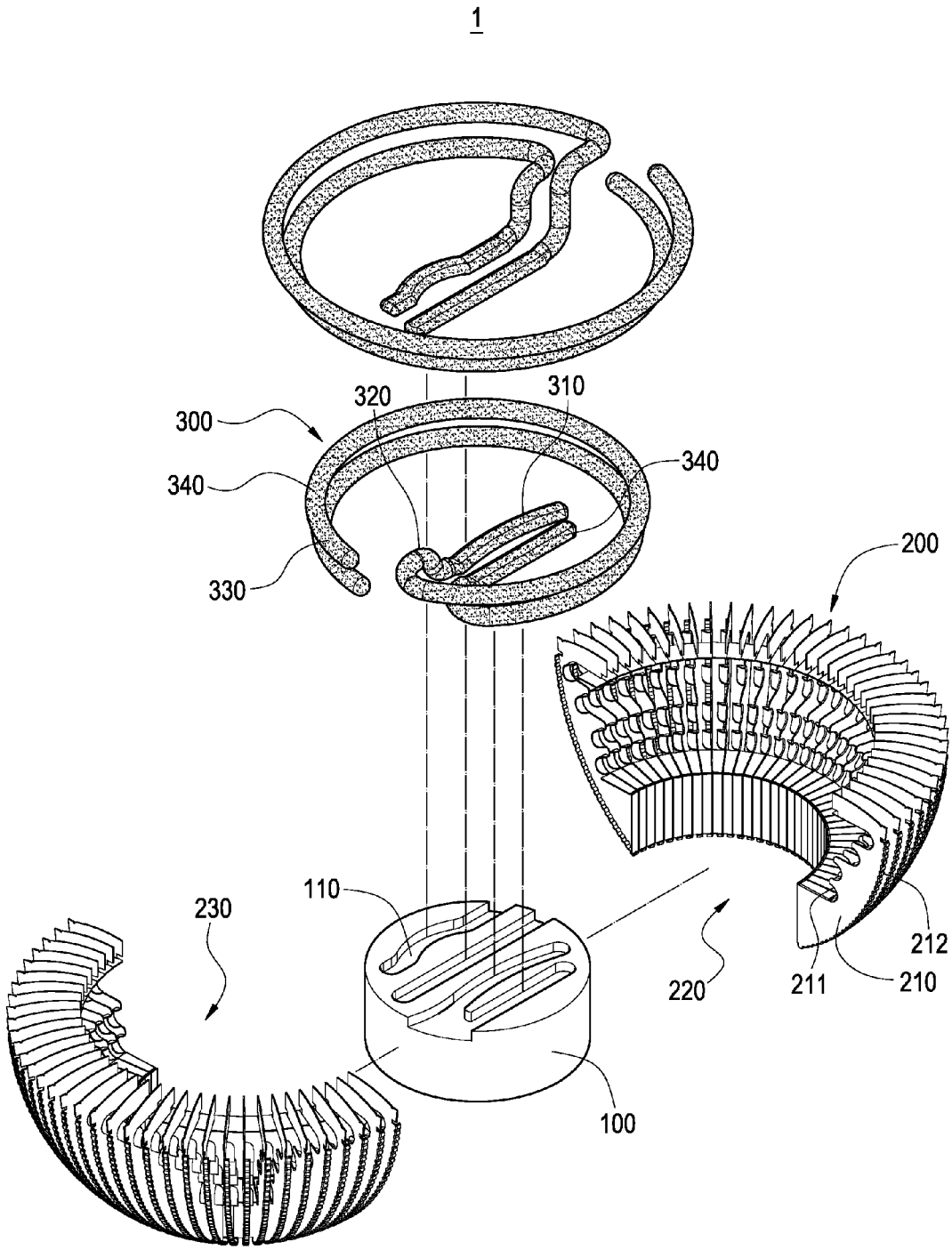
FIG. 1 is an exploded perspective view of a heat sink of the present invention.
Figure 2:
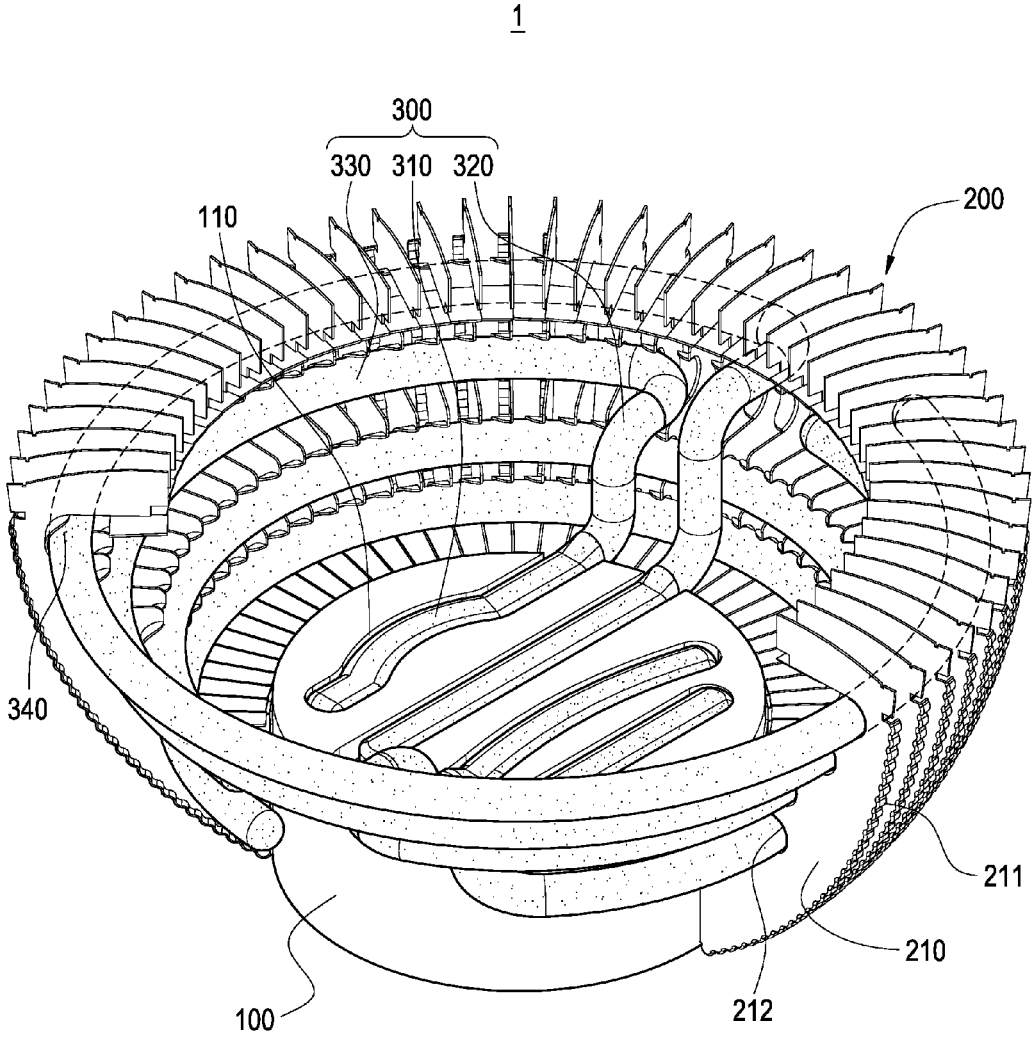
FIG. 2 is an assembled perspective view of the heat sink of the present invention.
Figure 3:
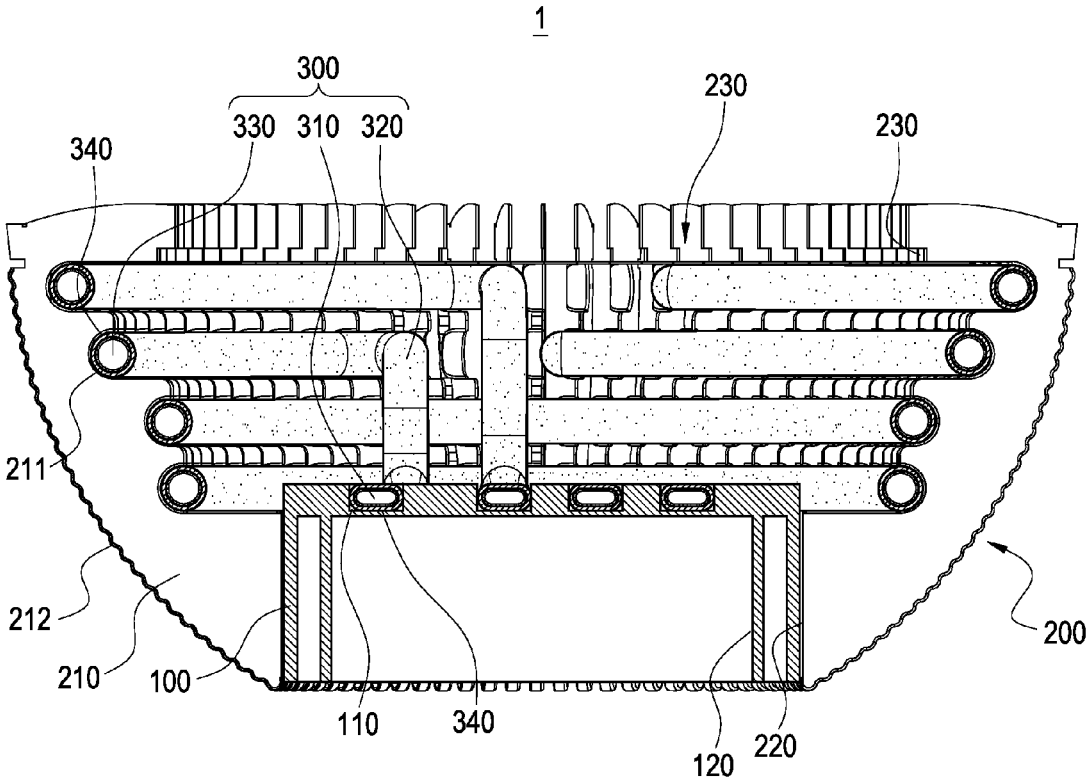
FIG. 3 is an assembled cross-sectional view of the heat sink of the present invention.

The present invention relates to a heat sink having a wound heat pipe. Please refer to FIGS. 1 to 3. The heat sink 1 includes a heat-conducting base 100, a heat-dissipating fin set 200, and at least one wound heat pipe 300.

The heat-conducting base 100 is made of materials having good heat conductivity and may be made of metals including but not limited to copper, aluminum or the like. One side of the heat-conducting base 100 is provided with an insertion slot 110 and the other side thereof is provided with a connecting trough 120.

The heat-dissipating fin set 200 comprises a plurality of heat-dissipating fins 210 arranged radially at intervals. The heat-dissipating fins 210 may be combined together to form one body by means of fastening, soldering, binding or screw elements (but not limited thereto). The heat-dissipating fins 210 may be made of materials having good heat conductivity such as metals including but not limited to copper, aluminum or the like.

The heat-dissipating fins 210 enclose to form a central hole 220 for allowing the heat-conducting base 100 to be inserted therein. That is, the inner lower portions of the heat-dissipating fins 210 enclose to form the central hole 220 for allowing the heat-conducting base 100 to be inserted therein. Furthermore, the inner lower portions of the heat-dissipating fins 210 are connected to the outer periphery of the heat-conducting base 100.

An accommodating space 230 is formed in on side of the heat-dissipating fins 210 on which the central hole 220 is formed. That is, the inner upper portions of the heat-dissipating fins 210 enclose to form the accommodating space 230 overlapping the central hole 220. The insertion slot 110 is in communication with the accommodating space 230. The connecting trough 120 is provided on one side of the heat-conducting base 100 opposite to the accommodating space 230.

An annular groove 211 is formed in the inner upper portions of the heat-dissipating fins 210 in communication with the accommodating space 230. More specifically, the inner surfaces of the heat-dissipating fins 210 are provided with a notch respectively in such a manner that these notches are connected in series to form the annular groove 211.

The outer surfaces of the respective heat-dissipating fins 210 are provided with embossments 212. More specifically, each of the embossments 212 is formed on one side of the respective heat-dissipating fins 210 opposite to the accommodating space 230, thereby increasing the heat-dissipating area of the heat-dissipating fins 210 and protecting a user from getting hurt by sharp edges of the heat-dissipating fins 210.

The structure of the wound heat pipe 300 is conventional and not the characteristic of the present invention, and thus the description thereof is omitted thereof. The wound heat pipe 300 is disposed in the accommodating space 230 and connected to one side of the heat-conducting base 100. The wound heat pipe 300 is inserted into the annular groove 211. In other word, the wound heat pipe 211 is wound on the inner upper portions of the heat-dissipating fins 210.

More specifically, one end of the wound heat pipe 300 is inserted into the insertion slot 110. Further, the end of the wound heat pipe 300 inserted into the insertion slot 110 is in flush with the heat-conducting base 100 (i.e. without protruding from the surface of the heat-conducting base 100). The other end of the wound heat pipe 300 is wound upwardly to be inserted into the annular groove 211.

Next, the arrangement of the wound heat pipe 300 is explained in more detail. The wound heat pipe 300 includes an evaporating section 310, a heat-conducting section 320 and a condensing section 330. The evaporating section 310, the heat-conducting section 320 and the condensing section 330 are disposed in the accommodating space 230. The evaporating section 310 is inserted into the insertion slot 110 and connected to one side of the heat-conducting base 100. The evaporating section 310 is in flush with the heat-conducting base 100 and brought into thermal contact therewith. The heat-conducting section 320 and the condensing section 330 are inserted into the annular groove 211 and wound upwardly to thermally contact with the inner surfaces of the heat-dissipating fins 210.

The wound heat pipe 300 further includes a heat-conducting medium 340 applied between the evaporating section 310 and the heat-conducting base 100 as well as the condensing section 330 and the heat-dissipating fins 210.

The heat sink 1 further includes another wound heat pipe 300. These two wound heat pipes 300 are arranged in such a manner that their condensing sections 330 overlap with each other. In this way, the heat can be distributed uniformly to the whole region of the heat-dissipating fins 210. The evaporating sections 310 of these two wound heat pipes 300 are brought into thermal contact with the heat-conducting base 100, thereby increasing the heat-conducting area and improving the heat-dissipating efficiency greatly.

Alternatively, the heat sink 1 further includes another wound heat pipe 300 wound in different directions to reduce the heat-conducting path and accelerate the heat-conducting speed. These two wound heat pipes 300 are arranged in such a manner that their condensing sections 330 overlap with each other, thereby distributing the heat uniformly to the whole region of the heat-dissipating fins 210. The evaporating sections 310 of these two wound heat pipes 300 are brought into thermal contact with the heat-conducting base 100, thereby increasing the heat-conducting area and improving the heat-dissipating efficiency greatly.

Figure 4:
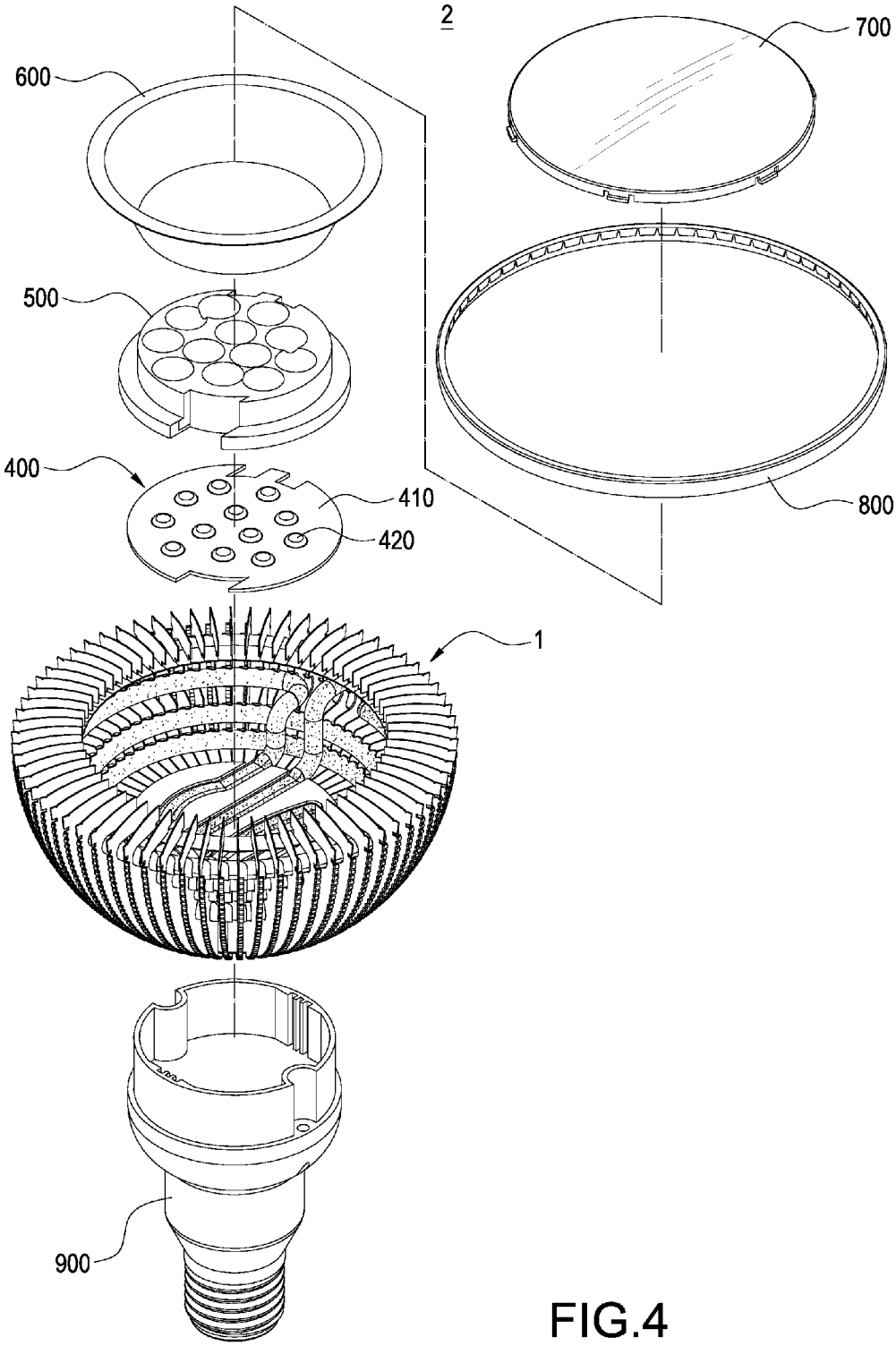
FIG. 4 is an exploded perspective view of a LED lamp of the present invention.
Figure 5:
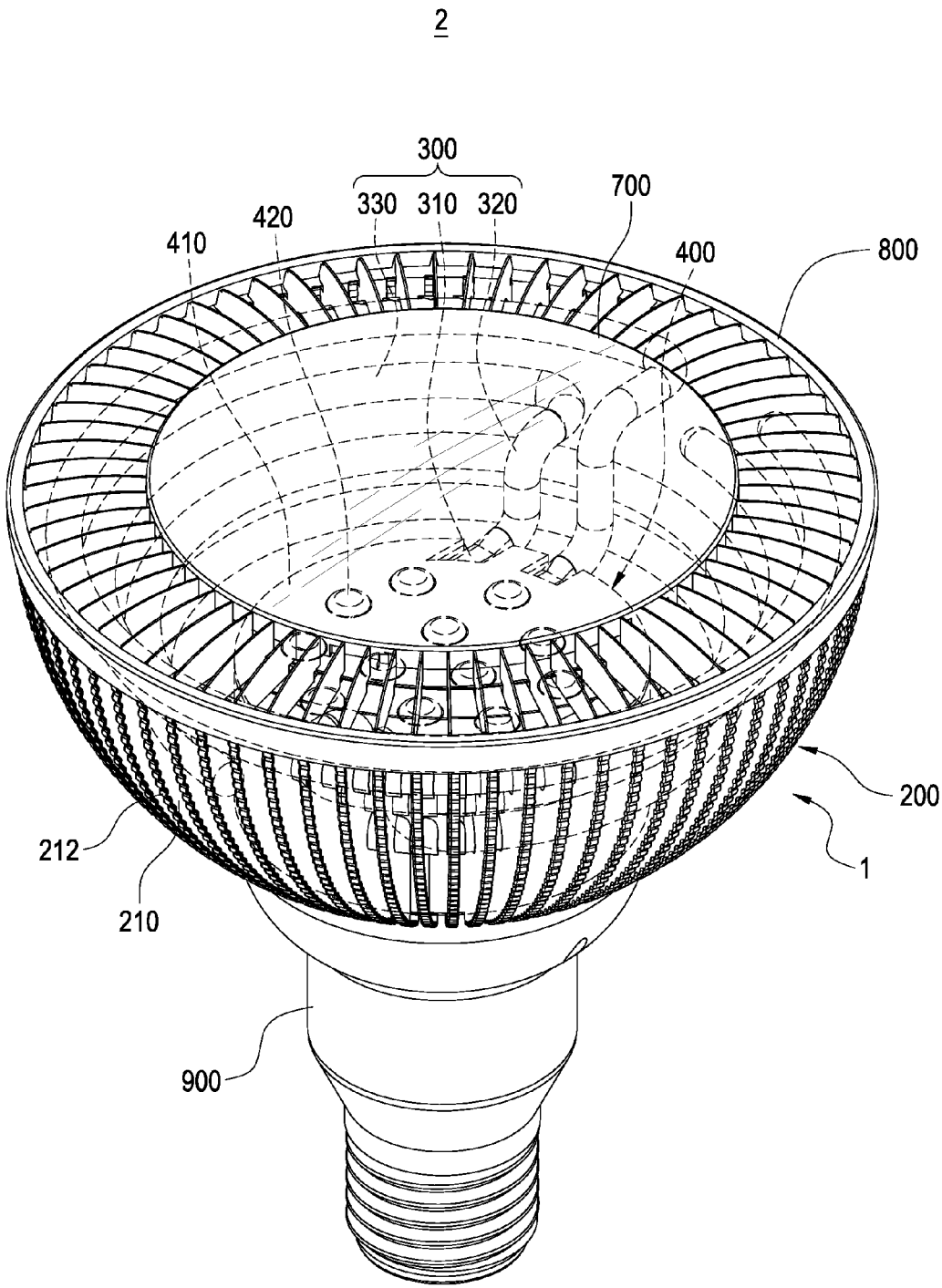
FIG. 5 is an assembled perspective view of the LED lamp of the present invention.
Figure 6:
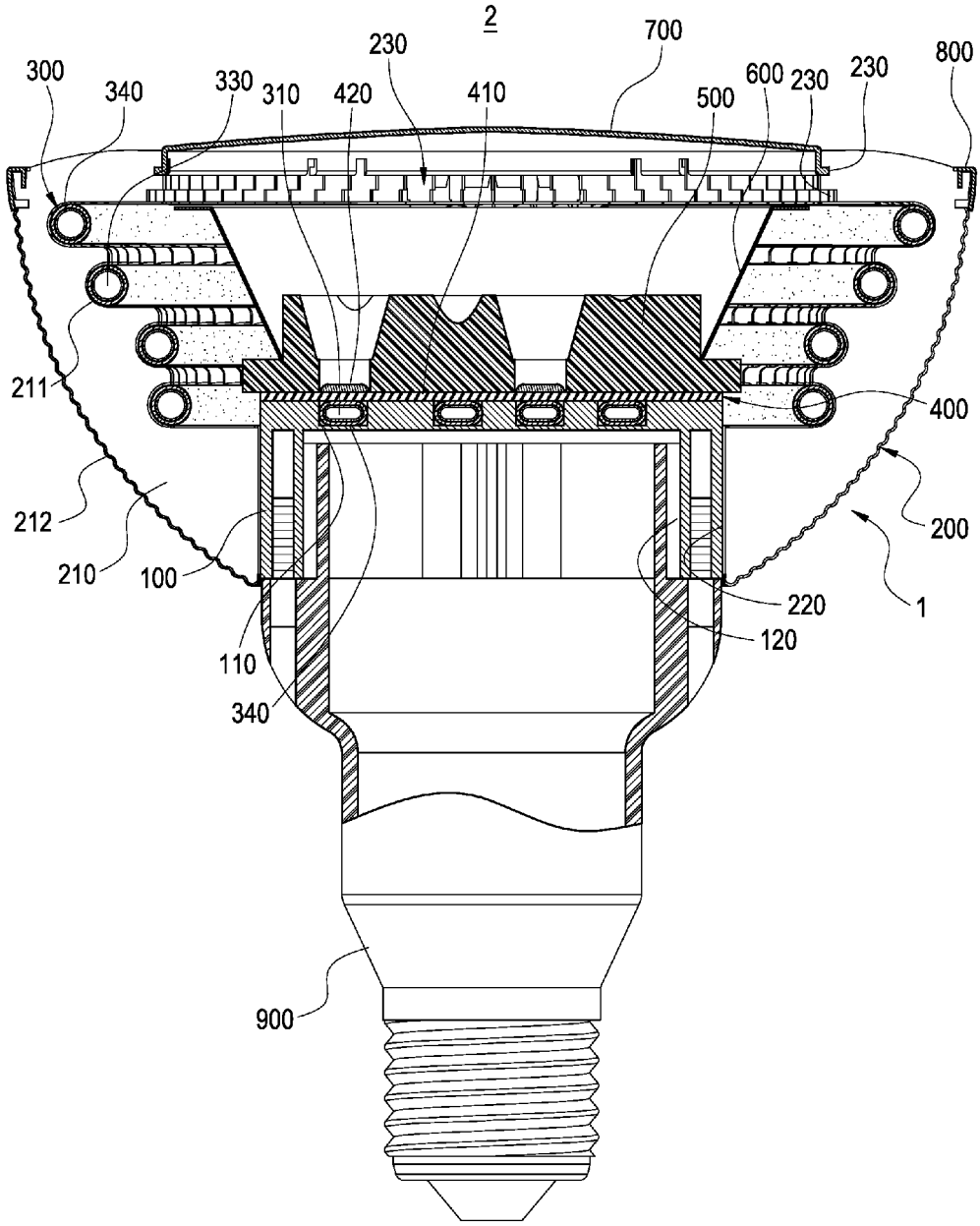
FIG. 6 is an assembled cross-sectional view of the LED lamp of the present invention.

The present invention also provides a LED lamp. Please refer to FIGS. 4 to 6. The LED lamp 2 includes a heat sink 1 having a wound heat pipe, a LED module 400, a lens 500, a reflecting shroud 600, a transparent cover 700, a supporting ring 800 and a lamp base 900.

The structure of the heat sink 1 has been mentioned in the above, and thus the redundant description is omitted.

The LED module 400 is disposed in the accommodating space 230 to abut against one side of the heat-conducting base 100 and one end of the wound heat pipe 300. Since the evaporating section 310 is in flush with the heat-conducting base 100, the evaporating section 310 and the heat-conducting base 100 can be brought into flat contact with the LED module 400. More specifically, the LED module 400 comprises a circuit board 410 and a plurality of LEDs 420 arranged on one surface of the circuit board 410 and electrically connected thereto.

The other surface of the circuit board 410 abuts against one side of the heat-conducting base 100 and is brought into thermal contact with one end (i.e. the evaporating section 310) of the wound heat pipe 300. The heat generated by the LEDs 420 is conducted from the circuit board 410 to the heat-conducting base 100 and the evaporating section 310 of the wound heat pipe 300. Then, the heat is conducted from the heat-conducting base 100 to the lower portions of the heat-dissipating fins 210 for heat dissipation. Also, the heat can be rapidly conducted by the wound heat pipe 300 to the upper portions of the heat-dissipating fins 210 for heat dissipation.

Further, an insulating layer (not shown) is sandwiched between the circuit board 410 and the heat-conducting base 100 as well as the circuit board 410 and the wound heat pipe 300, thereby preventing the circuit board 410 from generating a short circuit.

The lens 500 is disposed in the accommodating space 230 and surrounded by the wound heat pipe 300. The lens 500 covers the LED module 400. That is, the lens 500 is disposed on one side of the circuit board 410 to cover the LEDs 420. The lens 500 is configured to distribute the light spots emitted by the LEDs into a surface for illumination.

The reflecting shroud 600 is disposed in the accommodating space 230 and surrounded by the wound heat pipe 300. The reflecting shroud 600 is provided on one side of the lens 500 for reflecting the light emitted by the LEDs 420 to the outside of the lamp 2 for light projection.

The transparent cover 700 is connected to the inner top portions of the heat-dissipating fins 210 to thereby close the accommodating space 230. The transparent cover 700 allows the light emitted by the LEDs 420 to the outside. The transparent cover 700 is configured to prevent external matters from entering the accommodating space 230 and thus preventing the LED module 400 from suffering damage.

The supporting ring 800 is mounted to the outer top portions of the heat-dissipating fins 210. More specifically, the supporting ring 800 is mounted on one side of the heat-dissipating fins 210 outside the accommodating space 230. The supporting ring 800 reinforces the connection between the respective heat-dissipating fins 210 and protects a user from getting hurt by the sharp edges of the heat-dissipating fins 210.

The lamp base 900 is disposed on the other side of the heat-conducting base 100 and electrically connected to the LED module 400. The structure of the lamp base 900 and the electrical connection between the lamp base 900 and the LED module 400 are conventional, and thus the description relating thereto are omitted for simplicity.

The lamp base 900 is inserted into the connecting trough 120. The lamp base 900 can be fixed to the heat-conducting base 100 by means of fastening, soldering, binding or screw elements (but not limited thereto). After the lamp base 900 is electrically connected to an external lamp socket, the LED module 400 can be supplied with electricity.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A heat sink including:

a heat-conducting base;

a heat-dissipating fin set comprising a plurality of heat-dissipating thin fin plates arranged radially at intervals for enclosing the heat-conducting base, a central hole and an accommodating space being formed inside the heat-dissipating fin set, the heat-conducting base being received in the central hole with its peripheral brought into thermal contact with first inner portions of the heat-dissipating thin fin plates, at least one annular groove in communication with the accommodating space being formed on second inner portions of the heat-dissipating thin fin plates; and at least one wound heat pipe comprising an evaporating section at one distal end brought into thermal contact with the heat-conducting base, and a condensing section at the other distal end received in the annular groove and brought into thermal contact with the heat-dissipating thin fin plates.

2. The heat sink according to claim 1, wherein an outer edge of each of the heat-dissipating thin fin plates is formed with a plurality of embossments to increase heat-dissipating areas and protecting a user from getting hurt by sharp edges of the heat-dissipating thin fin plates.

3. The heat sink according to claim 1, wherein the heat-conducting base is provided with an insertion slot in communication with the accommodating space for allowing the evaporating section to be received therein.

4. The heat sink according to claim 1, wherein there are two annular grooves formed on the second inner portions of the heat-dissipating thin fin plates, and there are two wound heat pipes in same winding direction respectively received in the two annular grooves and brought into thermal contact with the heat-dissipating thin fin plates.

5. The heat sink according to claim 1, wherein there are two annular grooves formed on the second inner portions of the heat-dissipating thin fin plates, and there are two wound heat pipes in different winding direction respectively received in the two annular grooves and brought into thermal contact with the heat-dissipating thin fin plates.

6. The heat sink according to claim 1, further including a heat-conducting medium applied between the evaporating section and the heat-conducting base as well as the condensing section and the heat-dissipating thin fin plates.

7. The heat sink according to claim 3, wherein the evaporating section is in flush with the heat-conducting base.

8. A LED lamp, including:

a heat sink, comprising:

a heat-conducting base;

a heat-dissipating fin set comprising a plurality of heat-dissipating thin fin plates arranged radially at intervals for enclosing the heat-conducting base, a central hole and an accommodating space being formed inside the heat-dissipating fin set, the heat-conducting base being received in the central hole with its peripheral brought into thermal contact with first inner portions of the heat-dissipating thin fin plates, at least one being formed on second inner portions of the heat-dissipating thin fin plates; and at least one wound heat pipe comprising an evaporating section at one distal end brought into thermal contact with the heat-conducting base, and a condensing section at the other distal end received in the annular groove and brought into thermal contact with the heat-dissipating thin fin plates;

a LED module disposed in the accommodating space to abut against one side of the heat-conducting base and the evaporating section; and a lamp base provided on the other side of the heat-conducting base and electrically connected to the LED module.

9. The LED lamp according to claim 8, wherein the heat-dissipating base is provided with a connecting trough for allowing the lamp base to be engaged therein.

10. The LED lamp according to claim 8, wherein the heat-conducting base is provided with an insertion slot in communication with the accommodating space for allowing the evaporating section to be received therein.

11. The LED lamp according to claim 8, wherein an outer surface of each of the heat-dissipating thin fin plates is provided with a plurality of embossments to increase heat-dissipating areas and protecting a user from getting hurt by sharp edges of the heat-dissipating thin fin plates.

12. The LED lamp according to claim 8, wherein there are two annular grooves formed on the second inner portions of the heat-dissipating thin fin plates, and there are two wound heat pipes in same winding direction respectively received in the two annular grooves and brought into thermal contact with the heat-dissipating thin fin plates.

13. The LED lamp according to claim 8, wherein there are two annular grooves formed on the second inner portions of the heat-dissipating thin fin plates, and there are two wound heat pipes in different winding direction respectively received in the two annular grooves and brought into thermal contact with the heat-dissipating thin fin plates.

14. The LED lamp according to claim 8, wherein the LED module comprises a circuit board abutting against one surface of the heat-conducting base and the evaporating section, and a plurality of LEDs electrically connected to the circuit board.

15. The LED lamp according to claim 8, further including a lens disposed in the accommodating space to cover the LED module.

16. The LED lamp according to claim 8, further including a reflecting shroud disposed in the accommodating space and surrounded by the wound heat pipe.

17. The LED lamp according to claim 8, further including a heat-conducting medium applied between the evaporating section and the heat-conducting base as well as the condensing section and the heat-dissipating thin fin plates.

18. The LED lamp according to claim 10, wherein the evaporating section is in flush with the heat-conducting base.

* * * * *